US009799953B2

(12) United States Patent
Apaydin et al.

(10) Patent No.: US 9,799,953 B2
(45) Date of Patent: Oct. 24, 2017

(54) ANTENNA ISOLATION

(71) Applicant: Microsoft Technology Licensing, LLC, Redmond, WA (US)

(72) Inventors: Nil Apaydin, Kirkland, WA (US); Javier R. De Luis, Kirkland, WA (US); Benjamin Shewan, Redmond, WA (US); Mark William Casebolt, Seattle, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 12 days.

(21) Appl. No.: 14/670,167

(22) Filed: Mar. 26, 2015

(65) Prior Publication Data

US 2016/0285161 A1 Sep. 29, 2016

(51) Int. Cl.

| | |
|---|---|
| ***H01Q 1/52*** | (2006.01) |
| ***H01Q 1/38*** | (2006.01) |
| ***H01Q 21/28*** | (2006.01) |
| *H01Q 1/24* | (2006.01) |
| *H01Q 9/42* | (2006.01) |

(52) U.S. Cl.

CPC ..... *H01Q 1/525* (2013.01); *H01Q 1/38* (2013.01); *H01Q 1/521* (2013.01); *H01Q 21/28* (2013.01); *H01Q 1/243* (2013.01); *H01Q 9/42* (2013.01)

(58) Field of Classification Search

CPC ..... H01Q 1/38; H01Q 1/525
USPC ..... 343/841
See application file for complete search history.

(56) References Cited

U.S. PATENT DOCUMENTS

| | | | |
|---|---|---|---|
| 5,329,067 | A | 7/1994 | Abe et al. |
| 5,952,983 | A | 9/1999 | Dearnley et al. |
| 6,025,812 | A | 2/2000 | Gabriel et al. |
| 6,426,723 | B1 | 7/2002 | Smith et al. |
| 7,352,328 | B2 | 4/2008 | Moon et al. |

(Continued)

FOREIGN PATENT DOCUMENTS

KR 1020090045764 A 5/2009

OTHER PUBLICATIONS

Song, et al., "Wideband MIMO Antenna With Enhanced Isolation for LTE, Wimax and WLAN Mobile Handsets", In Electronics Letters, vol. 50, Issue 10, May 8, 2014, 2 pages.

(Continued)

*Primary Examiner* — Huedung Mancuso
(74) *Attorney, Agent, or Firm* — Alleman Hall Creasman & Tuttle LLP

(57) ABSTRACT

A wireless radio communication device includes a printed circuit board, a plurality of antennas formed on the printed circuit board, and one or more out-of-plane isolation elements conductively coupled to a ground plane of the printed circuit board. Each antenna extends in a reference plane or in a plane parallel to the reference plane. Each out-of-plane isolation element extends in a direction transverse to the reference plane. Each antenna of the plurality of antennas is configured to resonate in a selected radio frequency (RF) band. The one or more out-of-plane isolation elements are configured to conduct a current in response to excitation of one or more associated antennas that contributes to at least partially cancelling an RF transmission coupling between the one or more antennas and one or more other antennas of the plurality of antennas.

20 Claims, 6 Drawing Sheets

(56) References Cited

U.S. PATENT DOCUMENTS

| | | | | |
|---|---|---|---|---|
| 7,525,502 | B2 | 4/2009 | Hui et al. | |
| 7,710,343 | B2 | 5/2010 | Chiu et al. | |
| 8,004,473 | B2 | 8/2011 | Chung et al. | |
| 8,077,095 | B2 | 12/2011 | Suh et al. | |
| 8,085,202 | B2 | 12/2011 | Ayatollahi et al. | |
| 8,115,686 | B2 | 2/2012 | Mumbru et al. | |
| 8,253,647 | B2 | 8/2012 | Le et al. | |
| 8,659,482 | B2 | 2/2014 | Kim et al. | |
| 8,750,798 | B2 | 6/2014 | Rao et al. | |
| 2005/0130743 | A1 | 6/2005 | Leifer | |
| 2007/0229364 | A1 | 10/2007 | Shor | |
| 2008/0136736 | A1* | 6/2008 | Proctor | H01Q 1/007 343/893 |
| 2008/0204347 | A1 | 8/2008 | Alvey et al. | |
| 2009/0009400 | A1 | 1/2009 | Kim et al. | |
| 2009/0027286 | A1 | 1/2009 | Ohishi et al. | |
| 2010/0103066 | A1 | 4/2010 | Shtrom et al. | |
| 2010/0119002 | A1 | 5/2010 | Hartenstein | |
| 2010/0156732 | A1 | 6/2010 | Ito et al. | |
| 2011/0098583 | A1 | 4/2011 | Pandia et al. | |
| 2011/0205134 | A1 | 8/2011 | Blumberg, Jr. | |
| 2012/0068905 | A1 | 3/2012 | Ayatollahi et al. | |
| 2012/0139793 | A1 | 6/2012 | Sharawi | |
| 2013/0050027 | A1 | 2/2013 | Kim et al. | |
| 2013/0099980 | A1 | 4/2013 | Hayashi | |
| 2013/0187823 | A1 | 7/2013 | Lo Hine Tong et al. | |
| 2013/0241793 | A1 | 9/2013 | Ai et al. | |
| 2014/0141731 | A1 | 5/2014 | Abudul-Gaffoor et al. | |
| 2014/0159981 | A1 | 6/2014 | Wang | |
| 2014/0242903 | A1 | 8/2014 | DeLuis et al. | |
| 2014/0320363 | A1 | 10/2014 | Ng et al. | |
| 2015/0002367 | A1 | 1/2015 | Kosaka et al. | |

OTHER PUBLICATIONS

Kobayashi, et al., "An Investigation of the Effect of Chassis Connections on Radiated EMI from PCBs", In Proceedings of IEEE International Symposium on Electromagnetic Compatibility, Aug. 14, 2006, 5 pages.

Kim, et al., "High Isolation Internal Dual-Band Planar Inverted-F Antenna Diversity System with Band-Notched Slots for MIMO Terminals", In Proceedings of the 36th European Microwave Conference, Sep. 10, 2006, pp. 1414-1417.

ISA European Patent Office, International Search Report and Written Opinion Issued in Application No. PCT/US2016/019007, May 24, 2016, WIPO, 15 Pages.

Li, Y. et al., "A Dual-Polarization Slot Antenna Using a Compact CPW Feeding Structure," IEEE Antennas and Wireless Propagation Letters, vol. 9, Mar. 2010, 4 pages.

Motorola, AP-7131 Specification Sheet, Available at https://www.zebra.com/content/dam/msi-new/assets/web/Business/Products/Wireless%20LAN%20Devices/WLAN%20Access%20Points/AP-7131/__Documents/__staticfiles/AP-7131__Spec-Sheet__0910-web.pdf, Available as Early as Feb. 2011, 6 pages.

Microstrip antenna, Wikipedia Entry, Available at https://web.archive.org/web/20111020072018/http://en.wikipedia.org/wiki/Microstrip_antenna, Available as Early as Oct. 2011, 4 pages.

ISA European Patent Office, International Search Report and Written Opinion Issued in Application No. PCT/US2014/017878, Jun. 18, 2014, WIPO, 11 pages.

Fingas, J., "TomTom's New GPS Watches Track Your Heart Rate Without a Chest Strap," Engadget Website, Available Online at http://www.engadget.com/2014104/03/tomtom-cardio-gps-watches/, Apr. 3, 2014, 8 pages.

Goode, L., "Samsung's New Gear Fit Needs to Work on the 'Fit' Part," re/code Website, Available Online at http://recode.net/2014/04/08/samsungs-new-gear-fit-needs-to-work-on-the-fit-part/, Apr. 8, 2014, 9 pages.

NDTV Correspondant, "Samsung Gear Fit, Gear 2 and Gear 2 Neo Go on Sale Worldwide," NDTV Gadgets360 Website, Available Online at http://gadgets.ndtv.com/wearables/news/samsung-gear-fit-gear-2-and-gear-2-neo-go-on-sale-worldwide-507220, Apr. 11, 2014, 3 pages.

Poeter, D., "Meet Simband, Samsung's Next-Gen Health Tracker," PC Mag Website, Available Online at http://www.pcmag.com/article2/0,2817,2458663,00.asp, May 28, 2014, 18 pages.

IPEA European Patent Office, Second Written Opinion Issued in PCT Application No. PCT/US2016/019007, dated Feb. 7, 2017, WIPO, 12 pages.

IPEA European Patent Office, International Preliminary Report on Patentability Issued in PCT Application No. PCT/US2016/019007, dated Jun. 23, 2017, WIPO 8 pages.

* cited by examiner

ANTENNA ISOLATION

BACKGROUND

A wireless communication device may utilize a plurality of antennas to communicate with other wireless devices (e.g., Wi-Fi, Bluetooth, proprietary wireless networks). Antennas may take various forms. For example, some antennas may be implemented as microstrip antennas printed onto a printed circuit board.

SUMMARY

Embodiments are disclosed that relate to mitigating electromagnetic coupling between antennas in a wireless communication device. One example provides a wireless radio communication device including a printed circuit board (PCB), a plurality of antennas coupled to the PCB, and one or more out-of-plane isolation elements conductively coupled to a ground plane of the PCB. Each antenna extends in a reference plane or a plane parallel to the reference plane, and each out-of-plane isolation element extends in a direction transverse to the reference plane. The one or more out-of-plane isolation elements are configured to conduct a current in response to excitation of one or more antennas that contributes to at least partially cancelling an RF transmission coupling between the one or more antennas and one or more other antennas of the plurality of antennas.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
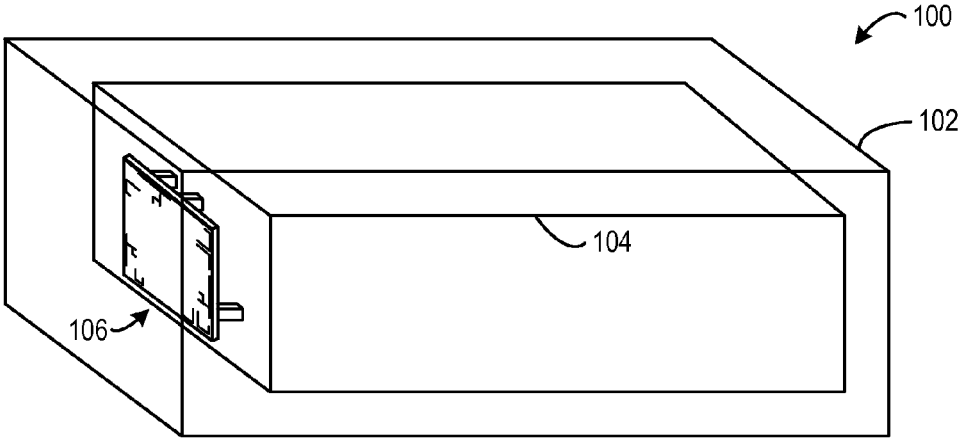
FIG. 1 shows an example wireless communication device.

Two or more antennas having similar resonant frequencies that are located in sufficiently close proximity, such as antennas formed on a PCB, may experience electromagnetic coupling. Such coupling reduces a transmission power of a signal radiated by an antenna, and also reduces a signal to noise ratio (S/N) of signals received at the coupled antennas. This may negatively impact the data rate and throughput of the wireless communication device.

As one non-limiting example, a device may comprise a multi-input, multi-output (MIMO) dual-band antenna pair for communicating with a WiFi access point, and also another dual-band antenna for communication with a different device, all operating simultaneously at 2.4 GHz and 5 GHz radio frequency (RF) communications bands. Where the antennas operate in close proximity (e.g., where each antenna is a microstrip antenna printed on a common PCB), coupling between antennas may impact performance to the extent that the advantages offered by the use of the antenna arrangement are not realized. Electromagnetic coupling may be mitigated, for example, by spacing the antennas farther apart. However, this also may result in increased device size.

Accordingly, examples are disclosed that relate to the use of various configurations of isolation elements that reduce coupling between such antennas. The disclosed arrangements of isolation elements are configured, when one antenna is excited, to collectively form a current null at the feed point into the PCB of one or more other antennas, thereby reducing coupling with the other antenna. The term "null" as used herein refers to the reduction of electromagnetic coupling at a feed point of an antenna compared to surrounding regions. Formation of such nulls may help to achieve desired isolation levels between antennas, and thereby realize the advantages of using multiple antennas of similar resonant frequencies in close proximity.

The disclosed examples may utilize various combinations of in-plane isolation elements and out-of-plane isolation elements. An in-plane isolation element is printed on a PCB along a plane of the PCB, and thus in a plane of antennas printed onto the PCB. An out-of-plane isolation element extends in a direction transverse to a plane of the PCB, and thus transverse to a plane of antennas formed on the PCB. Excitation of an antenna induces an in-plane current in a corresponding in-plane isolation element and an out-of-plane current in a corresponding out-of-plane isolation element, such that the currents produced in the isolation elements contribute to at least partially cancelling an RF transmission coupling at a feed point of another antenna. The use of one or more out-of-plane isolation elements in combination with one or more in-plane isolation elements may help to achieve greater isolation between antennas than the use of in-plane isolation elements alone. This may help to increase the power of a radiated transmission signal produced by an antenna, increase a S/N of signals received at the antenna, and allow for antennas to be positioned in closer physical proximity to each other relative to a configuration that lacks such isolation elements.

FIG. 1 shows an example wireless communication device 100. The wireless communication device 100 is shown in simplified form, and may represent any suitable device, including but not limited to personal computers, server computers, tablet computers, home-entertainment computers, network computing devices, gaming devices, mobile computing devices, and mobile communication devices (e.g., smart phones). The wireless communication device 100 includes an enclosure 102 that contains a metal chassis 104 and an antenna subsystem 106. The metal chassis 104 provides a supporting structure on which the antenna subsystem 106 and various other electronic components may be mounted.

Figure 3:
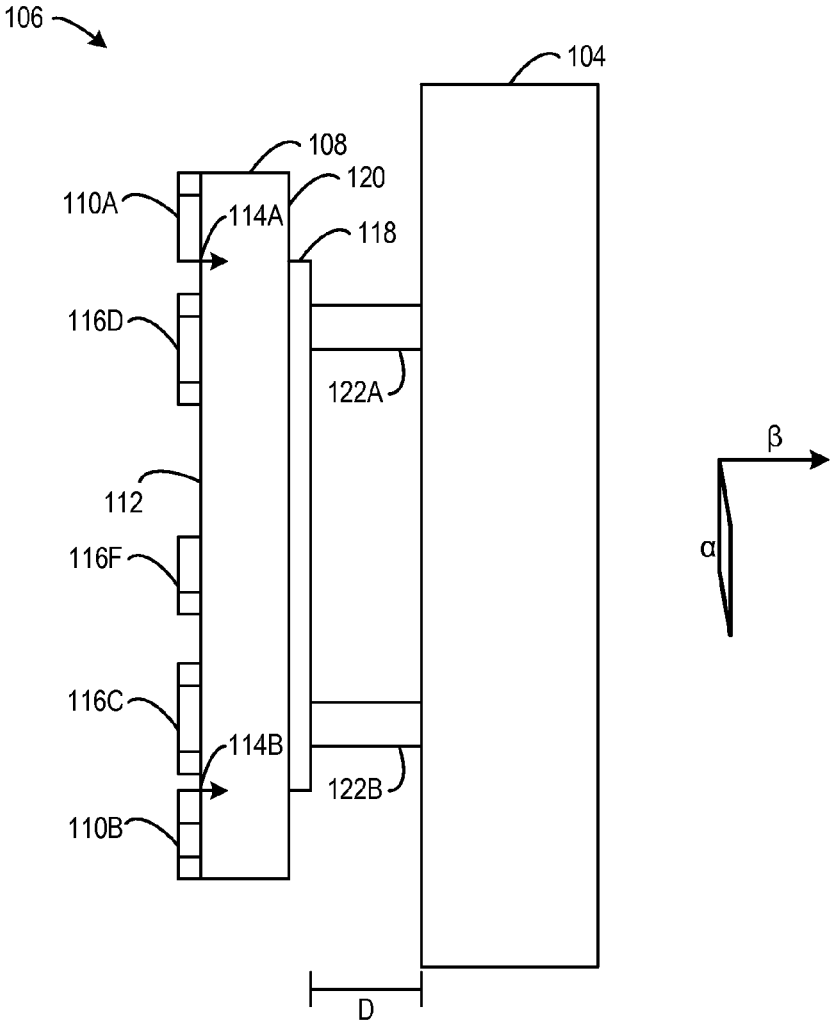
FIG. 3 shows a cross-sectional view of an example antenna subsystem of FIG. 2 taken along line A-A of FIG. 2.
Figure 2:
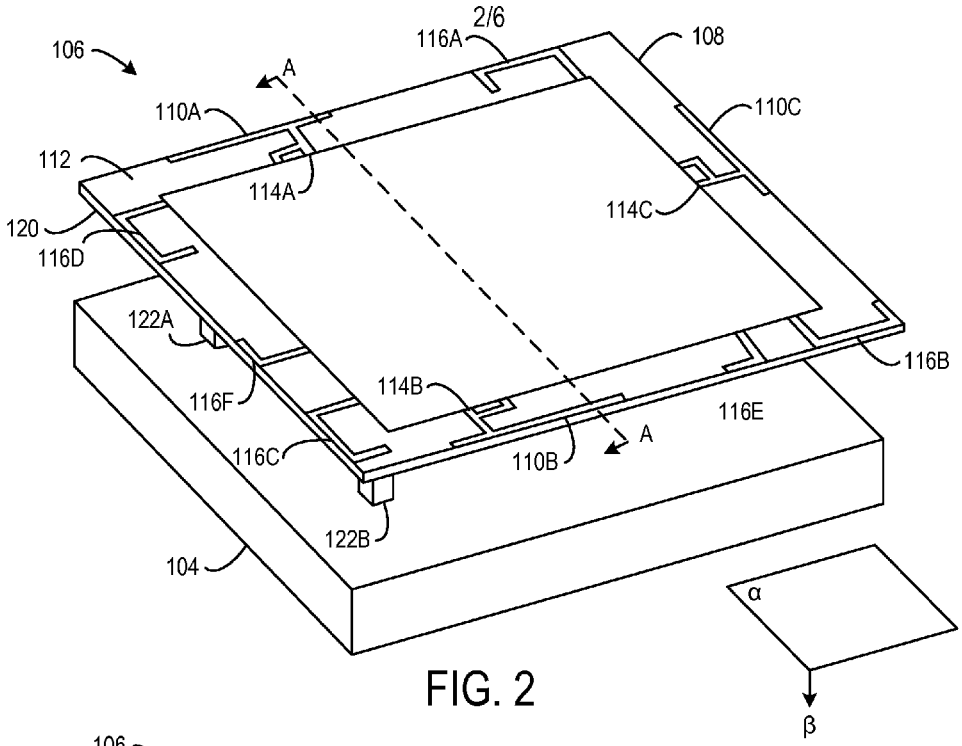
FIG. 2 shows a perspective view of an example antenna subsystem of the wireless communication device of FIG. 1, and illustrates an example arrangement of in-plane isolation elements.
Figure 4:
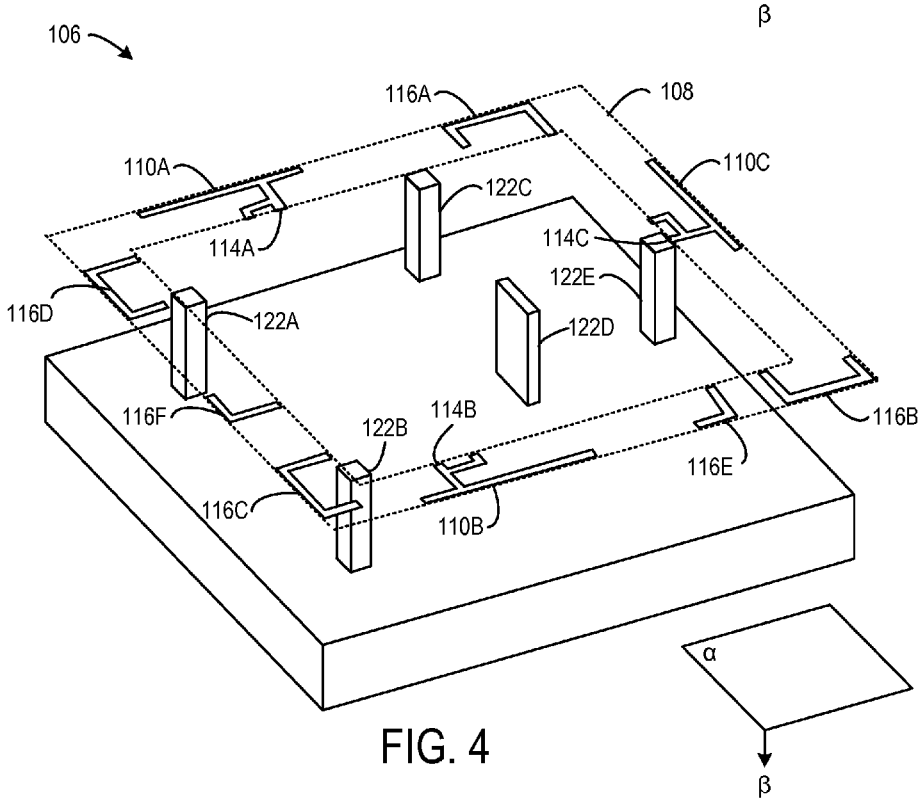
FIG. 4 shows a perspective view of the antenna subsystem of FIG. 2 with the PCB omitted, and illustrates an example arrangement of out-of-plane isolation elements.

FIGS. 2-4 show the antenna subsystem 106 in more detail. The antenna subsystem 106 includes a plurality of antennas 110 (110A, 110B, and 110C) coupled to a PCB 108. The depicted antennas 110 take the form of microstrip antennas printed on a side 112 of the PCB 108, such that the plurality of antennas 110 extend along a plane ($\alpha$) (defined by axis $\alpha$ and an axis normal to axes $\alpha$ and $\beta$) of the PCB 108. Each antenna of the plurality of antennas 110 has an associated feed point 114 (e.g., 114A, 114B, and 114C).

In other implementations, one or more antennas, such as stamped-metal antennas, may be coupled to but spaced from the PCB. In such implementations, the antennas may extend in one or more planes generally parallel to the printed circuit board. In yet other implementations, stamped metal antennas may extend in planes parallel to one another but not parallel to the PCB. Additionally, printed antennas may similarly be in different but parallel planes, e.g. if antennas are printed on different sides of a printed circuit board. In each of these implementations, the antennas may be considered as extending in a reference plane ($\alpha$ in the depicted example) or in a plane parallel to the reference plane, wherein the reference plane may be a plane of the printed circuit board or a plane transverse to the plane of the printed circuit board (PCB).

In some implementations, one or more of the plurality of antennas 110 may be multi-band antennas configured to simultaneously resonate at different radio frequencies. In one non-limiting example, as mentioned above, each antenna 110 may be a dual-band antenna that operates at both 2.4 GHz and 5 GHz frequencies. In some implementations, different antennas of the plurality of antennas 110 may be designated for transmitting RF signals according to different standards to communicate information over different networks and/or with different devices. Examples include, but are not limited to, Wi-Fi, WCDMA, HSDPA, 4G LTE, and Bluetooth. It will be understood that any suitable number of the plurality of antennas 110 may be used for transmitting RF signals according to any suitable standard(s).

A plurality of in-plane isolation elements 116 (e.g., 116A, 116B, 116C, 116D, 116E, and 116F) are formed on the PCB 108 and in the plane $\alpha$ of the PCB 108. The plurality of in-plane isolation elements 116 may take the form of parasitic elements each configured to conduct a current that contributes to at least partially cancelling an RF transmission coupling at a feed point of a selected antenna of the plurality of antennas 110 upon excitation of a different antenna of the plurality of antennas 110. The depicted in-plane isolation elements may be printed in a same process as the printing of the antennas, and therefore may be formed with minimal extra expense.

In implementations that utilize multi-band antennas, in-plane isolation elements may be provided for each RF communications band of the multi-band antennas, or for one or more bands to the exclusion of one or more other bands. In the depicted example, the in-plane isolation elements 116A, 116B, 116C, and 116D are configured to mitigate RF transmission coupling in the 2.4 GHz band, and in-plane isolation elements 116E and 116F are configured to mitigate RF transmission coupling in the 5 GHz band. The depicted in-plane isolation elements 116A, 116B, 116C, and 116D are larger in size than the in-plane isolation elements 116E and 116F due to the longer wavelength of the 2.4 GHz band relative to the 5 GHz band. In-plane isolation elements 116A, 116B, 116C, and 116D also may be referred to as a first set of in-plane isolation elements for a first frequency, and in-plane isolation elements 116E and 116F may be referred to as a second set of isolation elements for a second frequency. It will be understood that such sets of one or more isolation elements may be configured to help isolate antennas of any suitable resonant frequency or frequencies. Although the plurality of antennas are described herein in the context of fixed bands, the plurality of antennas may operate in wider spread spectrum implementations without departing from the scope of the present disclosure.

Different numbers of in-plane isolation elements may be used for the different RF bands. For example, a greater number of in-plane isolation elements may be employed for isolating antennas operating at 2.4 GHz than for isolating antennas operating at 5.0 GHz. This is illustrated in FIG. 3, wherein the antenna subsystem comprises four in-plane isolation elements for the 2.4 GHz antennas and two in-plane isolation elements for the 5 GHz antennas. In other examples, in-plane isolation elements may be provided for some bands but not others, depending upon a magnitude of electromagnetic coupling between antennas of each frequency. It will be understood that any suitable number of in-plane isolation elements may be used for each antenna frequency.

The in-plane isolation elements 116 may be positioned on the PCB 108 between different associated pairs of antennas of the plurality of antennas 110 to contribute to providing suitable isolation for each associated pair of antennas, namely, pair of antennas 110A and 110B, pair of antennas 110A and 110C, and pair of antennas 110B and 110C. The in-plane isolation elements that are located in between each antenna pair may contribute more to decoupling that antenna pair than in-plane isolation elements not located between that antenna pair, and thus may be considered as corresponding to that antenna pair. However, other in-plane isolation elements also may contribute to decoupling for an antenna pair.

The antenna subsystem 106 also comprises a ground plane 118 formed on a side 120 of the PCB 108 that opposes the side 112 on which the plurality of antennas 110 are formed, as illustrated in FIG. 2. The ground plane 118 may serve as a return path for current from the plurality of antennas 110 as well as other electrical elements formed on the PCB 108. The plurality of antennas 110 and the plurality of in-plane isolation elements 116 may be connected to the ground plane 118 through the PCB 108, or via any other suitable circuit path.

The antenna subsystem 106 is physically and conductively coupled to the metal chassis 104 via structures including out-of-plane isolation elements 122, most clearly illustrated at 122A, 122B, 122C, and 122D in FIG. 4. Each of the plurality of out-of-plane isolation elements 122 extends in a direction transverse to the plane $\alpha$ of the plurality of antennas 110 to conductively couple the ground plane 118 and the metal chassis 104. The plurality of out-of-plane isolation elements 122 may extend along a direction $\beta$ that is perpendicular to the plane $\alpha$, and/or in one or more other directions transverse to the plane of the plurality of antennas. In the depicted example, each of the plurality of out-of-plane isolation elements 122 takes the form of metal posts extending between and bonded to the ground plane 118 and the metal chassis 104. Such out-of-plane isolation elements also may be referred to herein as out-of-plane conductive elements.

The depicted out-of-plane isolation elements 122 play a dual role of providing physical coupling to the metal chassis 104 and also contributing to the formation of null currents at antenna feed points. As the plurality of out-of-plane isolation elements 122 extend in a direction that is transverse to the plane of the PCB 108, the electrical fields arising from currents in the out-of-plane isolation elements 122 have different directional characteristics than those of the in-plane isolation elements 116, and thus may contribute to the creation of current nulls at antenna feed points in a different manner than can be achieved using in-plane isolation elements 116. Further, the plurality of out-of-plane isolation elements 122 also may contribute to creating a relatively isotropic radiation pattern for each of the plurality of antennas 110. In other examples, separate structures may be used as out-of-plane isolation elements and physical couplings between the PCB 108 and metal chassis 104.

The plurality of out-of-plane isolation elements 122 may space apart the PCB 108 from the metal chassis 104 a selected distance D. The distance D may be selected to maintain suitable performance of the antennas formed on the PCB 108.

The plurality of antennas 110 may have any suitable arrangement on the PCB 108. For example, the plurality of antennas 110 may be arranged on the PCB 108 orthogonally to one another to leverage polarization discrimination that helps isolate the antennas from one another. In the depicted example, the antenna 110A is orthogonal to the antenna 110C and the antenna 110C is orthogonal to the antenna 110B.

As mentioned above, the depicted antennas may be configured as a multiple-input and multiple-output (MIMO) dual-band printed antenna pair comprising antenna 110A and 110C (referred to herein as "network antennas"), and another dual-band printed antenna 110B (referred to herein as the "accessory antenna"). In such an arrangement, each of the plurality of antennas 110 may be configured to simultaneously operate at a 2.4 GHz RF band and a 5 GHz RF band. More specifically, the pair of antennas 110A and 110C may be configured to operate as a 2×2 MIMO network configured to communicate with a remote Wi-Fi access point to provide network connectivity to the wireless communication device 100. The antenna 110B may be configured to communicate with another wireless device via another network (e.g., a proprietary wireless network, a Bluetooth connection). However, it will be understood that any suitable number and/or combination of pairs of antennas may be implemented in an antenna subsystem. Moreover, any of the plurality of antennas may operate in any suitable number of different bands, including bands other than those designated for Wi-Fi.

The number of out-of-plane isolation elements employed may be based upon the number of associated antenna pairs on the antenna subsystem 106. In some examples, at least one out-of-plane isolation element may be included to contribute to providing isolation between each associated antenna pair. Further, additional out-of-plane isolation elements may be employed for additional isolation, and/or for structural support of the antenna subsystem 106. In the depicted implementation, out-of-plane isolation element 122A is positioned to provide mechanical support for the antenna subsystem 106, and out-of-plane isolation element 122B is positioned to manipulate the radiation pattern of the antenna 110B to help avoid a null in the radiation field from this antenna. Out-of-plane isolation element 122C is positioned to increase isolation between the antenna 110A and the antenna 110C, and to increase return loss bandwidth of antenna 110A. The out-of-plane isolation element 122D is positioned to increase isolation between the antenna 110A and the antenna 110B, and the out-of-plane isolation element 122E is positioned to increase isolation between the antenna 110B and the antenna 110C.

Although the depicted out-of-plane isolation elements are rectangular in cross-sectional shape, the out-of-plane isolation elements may take any suitable form without departing from the scope of the present disclose. For example, in some implementations, the out-of-plane isolation elements may have an elliptical cross section, a polygonal cross section other than rectangular, or a curvilinear cross section. Moreover, the position of each of the plurality of out-of-plane isolation elements may vary as the number and/or type of antennas included in the antenna subsystem 106 varies.

The in-plane isolation elements of FIGS. 2-4 take the form of printed microstrip-type elements similar to the printed antennas. In this arrangement, the plurality of in-plane isolation elements 116 may not interfere with antenna feed lines and signal lines that travel through the PCB 108 to the ground plane 118. However, such a configuration may potentially increase the size of the PCB 108 in order to accommodate both a plurality of antennas and a plurality of in-plane isolation elements along a perimeter of the PCB 108.

Figure 5:
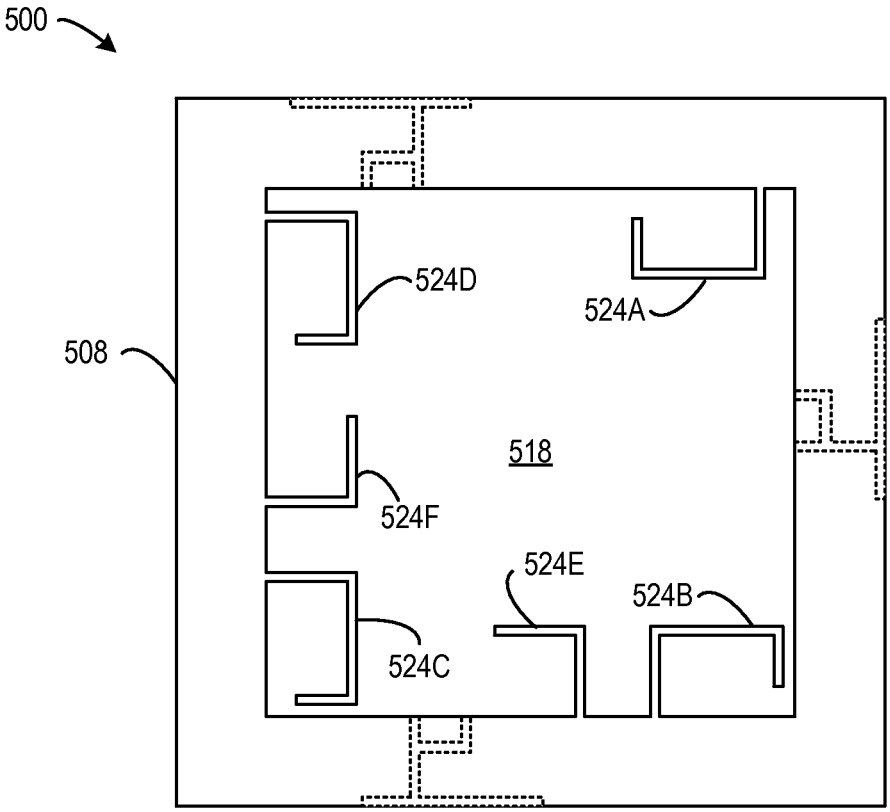
FIG. 5 shows another example arrangement of in-plane isolation elements.

In other examples, in-plane isolation elements may take the form of cutouts formed in a ground plane. FIG. 5 shows an example antenna subsystem 500 including a plurality of isolation cutouts 524 (e.g., 524A, 524B, 524C, 524D, and 524E) formed on a PCB 508. In particular, the plurality of isolation cutouts may be formed by and extend into a ground plane 518 that is bonded to the PCB 508. The depicted isolation cutouts 524 may be configured to resonate at 2.4 GHz in order to increase isolation between the antennas. In one example, the depicted isolation cutouts, when used with the antenna arrangement of FIG. 2 on a four square inch PCB, may provide isolation at 2.45 GHz that is greater than −30 dB. This configuration is merely one non-limiting example, and isolation cutouts may be configured to provide isolation between antennas in any suitable band. Further, such a configuration may potentially decrease a size of the PCB 508, as the in-plane isolation elements are not positioned on a perimeter of the PCB 508 allowing for more space for a plurality of antennas, but may complicate the design of antenna feed lines and signal lines that travel through the PCB 508 to the ground plane 518.

Figure 6:
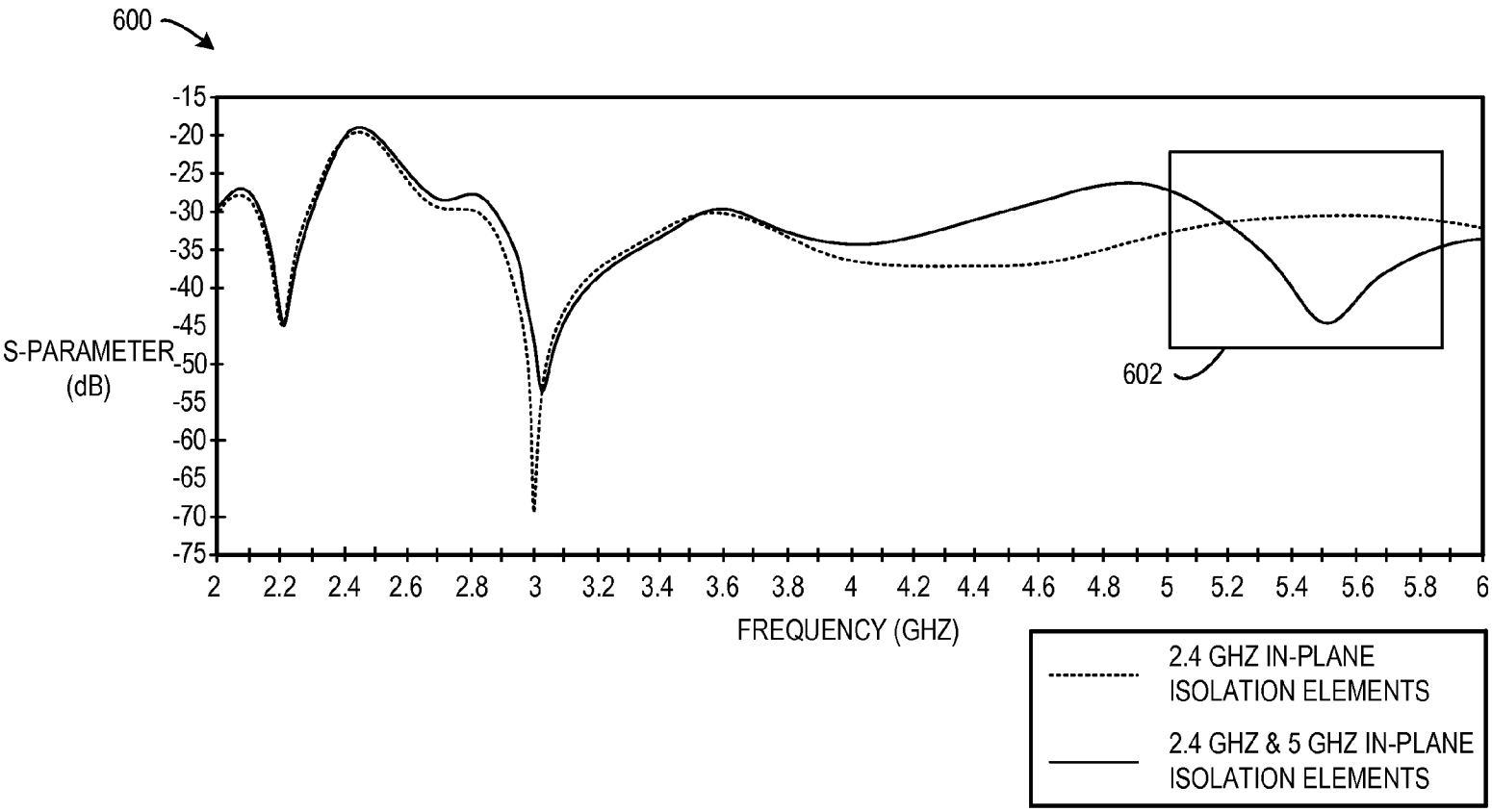
FIG. 6 shows a graph depicting example isolation characteristics of example wireless communication devices with and without 5 GHz in-plane isolation elements.

FIG. 6 shows a graph 600 depicting illustrating isolation characteristics for an antenna subsystem having in-plane isolation elements configured exclusively for the 2.4 GHz band as compared to an antenna subsystem having in-plane isolation elements configured for the 2.4 GHz band and for the 5 GHz band. The graph 600 depicts an S-parameter measured in decibels (dB) vs a transmission frequency measured in GHz. The S-parameter measures how much energy incident on one antenna is delivered by another antenna. The broken line trace represents isolation characteristics between an example associated antenna pair using in-plane isolation elements exclusively for the 2.4 GHz band, and the solid-line trace represents isolation characteristics between an example associated antenna pair of the antenna subsystem including in-plane isolation elements for both the 2.4 GHz and 5 GHz band. Box 602 highlights an increase in isolation at the 5 GHz band created by the antenna subsystem including the additional in-plane isolation elements configured for the 5 GHz band relative to a level of isolation provided by the antenna subsystem having the in-plane isolation elements configured exclusively for the 2.4 GHz band.

Figure 7:
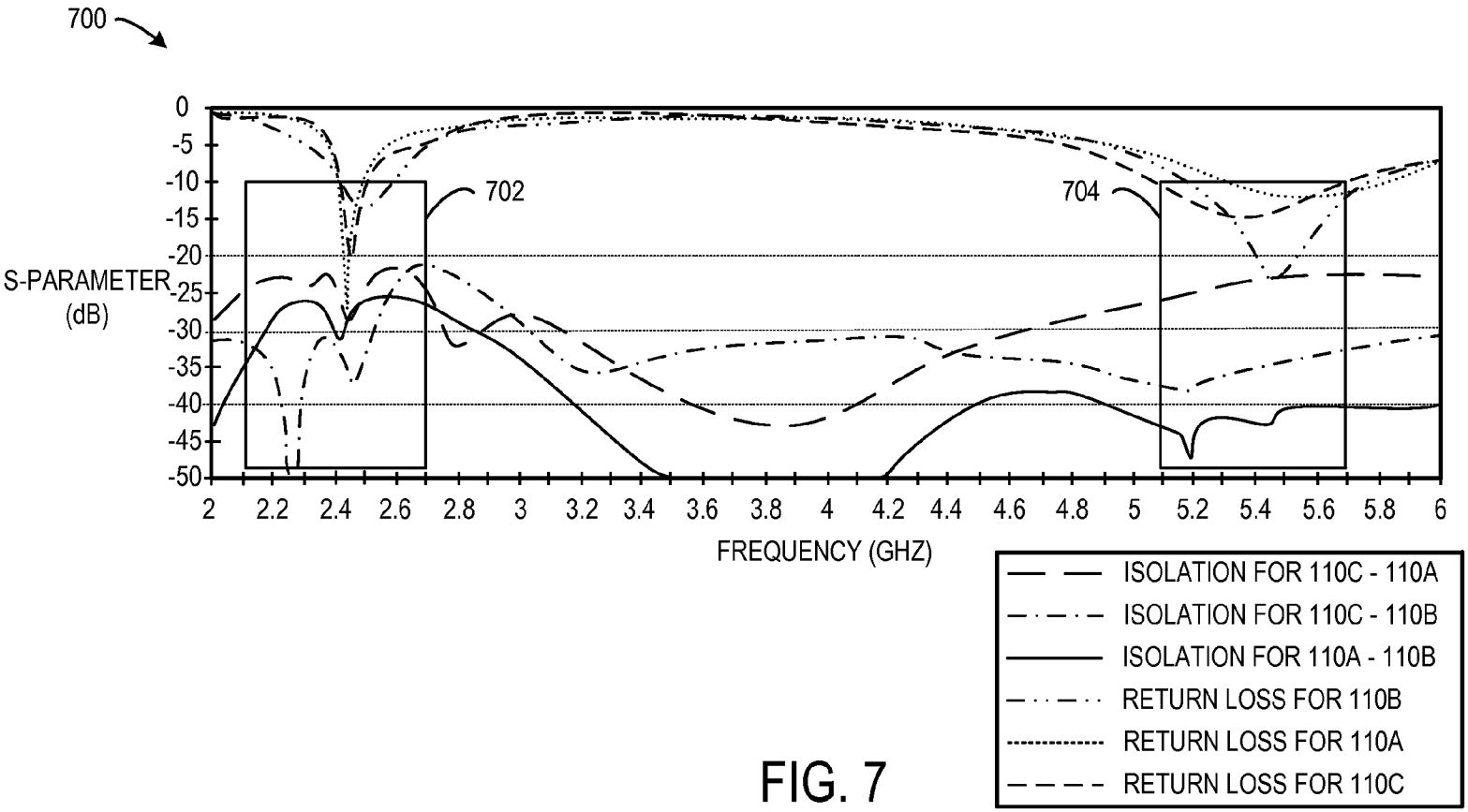
FIG. 7 shows a graph depicting example isolation and return loss characteristics of the wireless communication device of FIG. 1.

FIG. 7 shows a graph 700 depicting example isolation characteristics for an antenna subsystem 106 having the arrangement of in-plane isolation elements and out-of-plane isolation elements shown in FIGS. 2-4, and illustrates S-parameters in decibels (dB) compared to transmission frequency in GHz. The traces on the graph 700 represent isolation characteristics between different associated pairs of antennas of the antenna subsystem 106, as well as return loss characteristics of different antennas of the antenna subsystem 106.

Isolation of the antennas operating at the 2.4 GHz RF band is highlighted by box 702. As shown, the S-parameter for antenna pair 110A/110B is −23 dB/−29 dB (for 2.4 and 5 GHz respectively), the S-parameter for antenna pair 110B/110C is −30 dB/−38 dB, and the S-parameter for antenna par 110A/110C is −23 dB/−28 dB.

Isolation of the antennas operating at the 5 GHz RF band is highlighted by box 704. As shown, the S-parameter between antenna pair 110A/110B is −40 dB/−47 dB, the S-parameter between antenna pair 110B/110C is −32 dB/−38 dB, and the S-parameter between antenna pair 110A/110C is −22 dB/−25 dB.

Accordingly, isolation higher than 23 dB is attained between all antenna pairs at the 2.4 GHz band. Further, greater than 30 dB isolation is attained between each network antenna and the accessory antenna at the 5 GHz band. Additionally, greater than 40 dB isolation is attained between the network antenna 110A and the accessory antenna 110B at the 5 GHz band.

Figure 8:
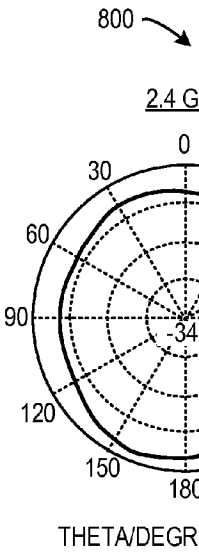
FIG. 8 shows a graph depicting an example radiation pattern of antennas of the antenna subsystem of FIG. 2 operating at a 2.4 GHz band.
Figure 9:
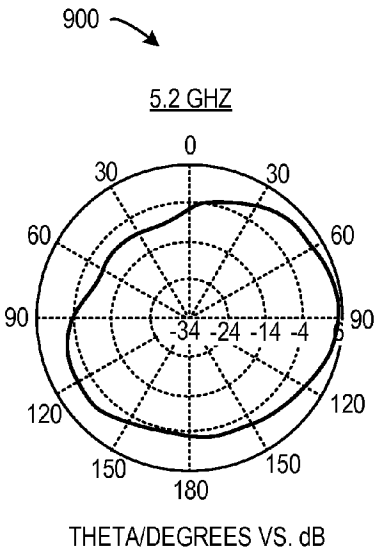
FIG. 9 shows a graph depicting an example radiation pattern of an antennas of the antenna subsystem of FIG. 2 operating at a 5.2 GHz band.
Figure 10:
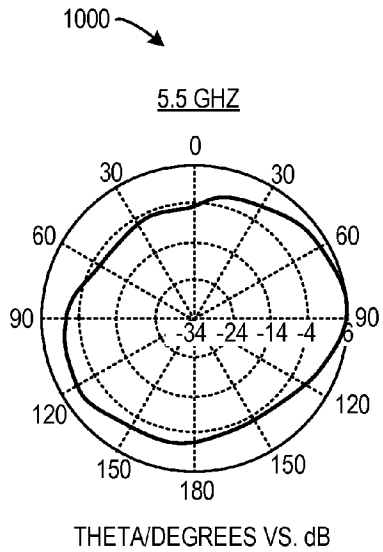
FIG. 10 shows a graph depicting an example radiation pattern of an antennas of the antenna subsystem of FIG. 2 operating at a 5.5 GHz band.
Figure 11:
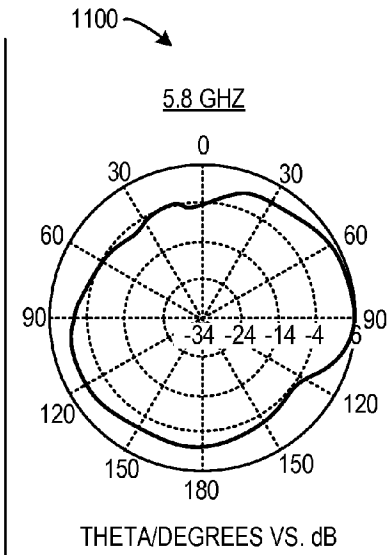
FIG. 11 shows a graph depicting an example radiation pattern of an antennas of the antenna subsystem of FIG. 2 operating at a 5.8 GHz band.

FIG. 8 shows a graph 800 depicting an example radiation pattern of an example antenna of the wireless communication device 100 operating at the 2.4 GHz RF band, and FIGS. 9-11 shows graphs 900, 1000, and 1100 depicting example radiation patterns of an example antenna of the wireless communication device 100 operating at frequencies proximate to the 5 GHz RF band (more specifically, 5.2 GHz, 5.5 GHz, and 5.8 GHz respectively).

Each of the graphs 800, 900, 1000, and 1100 show that the representative antenna produces a substantially isotropic radiation pattern without any deep nulls in any direction at each of the different frequencies. Such radiation patterns indicate that the representative antenna is sufficiently isolated to provide a suitably strong transmission signal intensity in all directions. Thus, the disclosed isolation element configurations may allow for the plurality of antennas 110 to be closely spaced (e.g., within a quarter wavelength of a frequency of interest) on a common printed circuit board (PCB) 108 in order to reduce a form factor of the antenna subsystem 106 in the wireless communication device 100. In one non-limiting example, the antenna and isolation element configuration of FIGS. 2 and 4, in which all three antennas are 2.4 GHz/5 GHz dual band antennas, may be formed on a 4900 square millimeter printed circuit board and achieve the antenna isolation S parameters illustrated in FIG. 7.

Although the various antenna isolation elements and features of the wireless radio communication device 100 are discussed above in the context of providing isotropic radiation patterns, such isolation elements and features also may be applicable to directional antenna applications. In one non-limiting example, such isolation elements and features may be employed in a multi-element antenna array used for beamforming to provide isolation between each of the antennas of the array.

Another example provides a wireless radio communication device comprising a printed circuit board, a plurality of antennas formed on the printed circuit board, each antenna configured to resonate in a selected radio frequency (RF) band, each antenna extending in a reference plane or in a plane parallel to the reference plane, and one or more out-of-plane isolation elements conductively coupled to a ground plane of the printed circuit board and extending in a direction transverse to the reference plane of the plurality of antennas, the one or more out-of-plane isolation elements being configured to conduct a current in response to excitation of one or more antennas that contributes to at least partially cancelling an RF transmission coupling between the one or more antennas and one or more other antennas antenna of the plurality of antennas. In such an example, the wireless radio communication device optionally may comprise one or more in-plane isolation elements coupled to the printed circuit board and in a plane parallel to the reference plane, the one or more in-plane isolation elements being configured to conduct a current in response to excitation of the one or more associated antennas that also contributes to at least partially cancelling the RF transmission coupling between the two or more antennas of the plurality of antennas. In such an example, the plurality of antennas optionally may include stamped-metal antennas having a feed point on the PCB and being spaced apart from the PCB. In such an example, the plurality of antennas may include microstrip antennas formed on the PCB. In such an example, the one or more in-plane isolation elements optionally may include a plurality of cutouts extending into the ground plane of the printed circuit board. In such an example, each of the one or more in-plane isolation elements optionally may be positioned intermediate an associated pair of antennas of the plurality of antennas. In such an example, the wireless radio communication device optionally may further comprise a metal chassis, and the one or more out-of-plane isolation elements optionally may include a plurality of metal posts each connected between the ground plane of the printed circuit board and the metal chassis. In such an example, the plurality of in-plane isolation elements optionally may include a first set of one or more isolation elements and a second set of one or more isolation elements, the first set of one or more isolation elements corresponding to a first RF band between two or more of the plurality of antennas, and the second set of one or more isolation elements corresponding to a second RF band between two or more of the plurality of antennas, and wherein a number of isolation elements in the first set differs from a number of isolation elements in the second set. Any or all of the above-described examples may be combined in any suitable manner in various implementations.

Another example provides a wireless radio communication device comprising a printed circuit board, a plurality of antennas formed on the printed circuit board, each antenna configured to resonate in a selected radio frequency band, and an isolation element configured such that excitation of a first antenna of the plurality of antennas at a resonant frequency induces an out-of-plane current in the isolation element in a direction transverse to a plane of the printed circuit board that contributes to at least partially cancelling an RF transmission coupling at a feed point of a second antenna of the plurality of antennas. In such an example, the isolation element optionally may include an out-of-plane conductive element conductively coupled to a ground plane of the printed circuit board and extending in a direction transverse to a plane of the printed circuit board. In such an example, the wireless radio communication device optionally may further comprise a metal chassis, and the out-of-plane conductive element optionally may include a metal post connected between the ground plane of the printed circuit board and the metal chassis. In such an example, the wireless radio communication device optionally may further comprise an in-plane isolation element formed on the printed circuit board and in the plane of the printed circuit board. In such an example, the out-of-plane isolation element optionally may be coupled to the printed circuit board on an opposite side of the printed circuit board as the in-plane isolation element. In such an example, the in-plane isolation element optionally may include a conductive element formed on the printed circuit board and in the plane of the printed circuit board. In such an example, the in-plane isolation element optionally may include a cutout that extends into a ground plane of the printed circuit board. In such an example, the in-plane isolation element optionally may be positioned between the first antenna and the second antenna on the printed circuit board. Any or all of the above-described examples may be combined in any suitable manner in various implementations.

Another example provides a wireless radio communication device comprising a printed circuit board, three or more multi-band antennas formed on the printed circuit board, each multi-band antenna configured to resonate in two or more RF bands, a first set of one or more isolation elements each configured to conduct a current that at least partially cancels RF coupling at a first RF band of the two or more RF bands between two or more of the three or more multi-band antennas, and a second set of one or more isolation elements each configured to conduct a current that at least partially cancels RF coupling at a second RF band of the two or more RF bands between the two or more of the three or more multi-band antennas, wherein a number of isolation elements in the first set differs from a number of isolation elements in the second set. In such an example, the first set of one or more isolation elements and the second set of one or more isolation elements optionally may include in-plane isolation elements formed on the printed circuit board and in a plane of the printed circuit board. In such an example, the wireless radio communication device optionally may further comprise one or more out-of-plane isolation elements conductively coupled to a ground plane of the printed circuit board and extending in a direction transverse to a plane of the printed circuit board, the one or more out-of-plane isolation elements being configured to conduct a current in response to excitation of one or more associated antennas that contributes to at least partially cancelling an RF transmission coupling between two or more antennas of the plurality of antennas. In such an example, the wireless radio communication optionally may further comprise a metal chassis, and the one or more out-of-plane isolation elements optionally may include a plurality of metal posts each connected between the ground plane of the printed circuit board and the metal chassis. Any or all of the above-described examples may be combined in any suitable manner in various implementations.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A wireless radio communication device comprising:

a printed circuit board;

a plurality of antennas coupled to the printed circuit board, each antenna configured to resonate in a selected radio frequency (RF) band, and each antenna extending in a reference plane or in a plane parallel to the reference plane; and a plurality of out-of-plane isolation elements conductively coupled to a ground plane of the printed circuit board and extending in a direction transverse to the reference plane, each of the plurality of out-of-plane isolation elements being configured to conduct a current in response to excitation of one or more antennas that contributes to at least partially cancelling an RF transmission coupling between the one or more antennas and one or more other antennas of the plurality of antennas, and wherein an arrangement of the plurality of out-of-plane elements is based upon an arrangement of associated antenna pairs of the plurality of antennas.

2. The wireless radio communication device of claim 1, further comprising:

one or more in-plane isolation elements coupled to the printed circuit board and extending in a plane parallel to the reference plane, the one or more in-plane isolation elements being configured to conduct a current in response to excitation of the one or more associated antennas that also contributes to at least partially cancelling the RF transmission coupling between the two or more antennas of the plurality of antennas.

3. The wireless radio communication device of claim 2, wherein one or more of the plurality of out-of-plane isolation elements are coupled to the printed circuit board on an opposite side of the printed circuit board as the one or more in-plane isolation elements.

4. The wireless radio communication device of claim 2, wherein the plurality of antennas include stamped-metal antennas having a feed point on the printed circuit board and being spaced apart from the printed circuit board.

5. The wireless radio communication device of claim 2, wherein the plurality of antennas include microstrip antennas formed on the printed circuit board.

6. The wireless radio communication device of claim 2, wherein each of the one or more in-plane isolation elements is positioned intermediate an associated pair of antennas of the associated antenna pairs of the plurality of antennas.

7. The wireless radio communication device of claim 4, further comprising:

a metal chassis, wherein the plurality of out-of-plane isolation elements include a plurality of metal posts each connected between the ground plane of the printed circuit board and the metal chassis.

8. The wireless radio communication device of claim 1, further comprising a plurality of in-plane isolation elements including a first set of one or more isolation elements and a second set of one or more isolation elements, the first set of one or more isolation elements corresponding to a first RF band between two or more of the plurality of antennas, and the second set of one or more isolation elements corresponding to a second RF band between two or more of the plurality of antennas, and wherein the number of isolation elements in the first set differs from the number of isolation elements in the second set.

9. A wireless radio communication device comprising:

a printed circuit board;

a plurality of antennas formed on the printed circuit board, each antenna configured to resonate in a selected radio frequency band, wherein a first antenna of the plurality of antennas is located on a first side of the printed circuit board in a reference plane and a second antenna of the plurality of antennas is located on a second, different side of the printed circuit board in the reference plane; and an isolation element positioned intermediate the first antenna and the second antenna and configured such that excitation of the first antenna at a resonant frequency induces an out-of-plane current in the isolation element in a direction transverse to a plane of the printed circuit board that contributes to at least partially cancelling an RF transmission coupling at a feed point of the second antenna.

10. The wireless radio communication device of claim 9, wherein the isolation element includes an out-of-plane conductive element conductively coupled to a ground plane of the printed circuit board and extending in a direction transverse to the plane of the printed circuit board.

11. The wireless radio communication device of claim 10, further comprising:

a metal chassis, wherein the out-of-plane conductive element includes a metal post connected between the ground plane of the printed circuit board and the metal chassis.

12. The wireless radio communication device of claim 9, further comprising an in-plane isolation element formed on the printed circuit board and in the plane of the printed circuit board.

13. The wireless radio communication device of claim 12, wherein the out-of-plane isolation element is coupled to the printed circuit board on an opposite side of the printed circuit board as the in-plane isolation element.

14. The wireless radio communication device of claim 12, wherein the in-plane isolation element includes a conductive element formed on the printed circuit board and in the plane of the printed circuit board.

15. The wireless radio communication device of claim 12, wherein the in-plane isolation element includes a cutout that extends into a ground plane of the printed circuit board.

16. The wireless radio communication device of claim 12, wherein the in-plane isolation element is positioned between the first antenna and the second antenna on the printed circuit board.

17. A wireless radio communication device comprising:

a printed circuit board;

a plurality of antennas coupled to the printed circuit board, each antenna configured to resonate in a selected radio frequency (RF) band, and each antenna extending in a reference plane or in a plane parallel to the reference plane;

a plurality of in-plane isolation elements including a first set of one or more isolation elements and a second set of one or more isolation elements, the first set of one or more isolation elements corresponding to a first RF band between two or more of the plurality of antennas, and the second set of one or more isolation elements corresponding to a second RF band between two or more of the plurality of antennas, and wherein the number of isolation elements in the first set differs from the number of isolation elements in the second set; and one or more out-of-plane isolation elements conductively coupled to a ground plane of the printed circuit board and extending in a direction transverse to the reference plane, the one or more out-of-plane isolation elements being configured to conduct a current in response to excitation of one or more antennas that contributes to at least partially cancelling an RF transmission coupling between the one or more antennas and one or more other antennas of the plurality of antennas.

18. The wireless radio communication device of claim 17, wherein each of the plurality of in-plane isolation elements is positioned intermediate an associated pair of antennas of the plurality of antennas.

19. The wireless radio communication device of claim 17, wherein a first antenna of the plurality of antennas is located on a first side of the printed circuit board and a second antenna of the plurality of antennas is located on a second side of the printed circuit board different than the first side.

20. The wireless radio communication device of claim 19, further comprising:

a metal chassis, wherein the one or more out-of-plane isolation elements include a plurality of metal posts each connected between the ground plane of the printed circuit board and the metal chassis.

* * * * *